US010815740B2

(12) United States Patent
Mayenburg

(10) Patent No.: US 10,815,740 B2
(45) Date of Patent: Oct. 27, 2020

(54) APPARATUS AND METHODS FOR GRIPPING A TUBULAR MEMBER

(71) Applicant: Dreco Energy Services ULC, Edmonton (CA)

(72) Inventor: Kenneth Joseph Mayenburg, Edmonton (CA)

(73) Assignee: Dreco Energy Services, ULC, Edmonton, Alberta (CA)

( * ) Notice: Subject to any disclaimer, the term of this patent is extended or adjusted under 35 U.S.C. 154(b) by 320 days.

(21) Appl. No.: 15/867,381

(22) Filed: Jan. 10, 2018

(65) Prior Publication Data

US 2018/0195353 A1 Jul. 12, 2018

Related U.S. Application Data

(60) Provisional application No. 62/445,548, filed on Jan. 12, 2017.

(51) Int. Cl.
*E21B 19/16* (2006.01)

(52) U.S. Cl.
CPC ..... *E21B 19/163* (2013.01); *E21B 19/161* (2013.01)

(58) Field of Classification Search
CPC ..... B23P 11/005; B23P 19/04; E21B 19/16; Y10T 29/53657; Y10T 29/53683
See application file for complete search history.

(56) References Cited

U.S. PATENT DOCUMENTS 1,984,622 A 12/1934 Babin
2,933,961 A 4/1960 Adams
5,715,723 A * 2/1998 Owens ..... B21D 39/048 29/237
5,996,444 A 12/1999 Pearce et al.
9,677,352 B2 * 6/2017 Angelle ..... E21B 19/10
9,976,365 B2 * 5/2018 Vierke ..... E21B 19/07
2005/0160880 A1 * 7/2005 Schulze-Beckinghausen ..... E21B 19/163 81/57.34
2005/0188793 A1 * 9/2005 Cherry ..... E21B 19/164 81/57.33
2010/0050817 A1 3/2010 Hauk et al.
2014/0115860 A1 * 5/2014 Sarh ..... B62D 57/024 29/428
2016/0163914 A1 * 6/2016 Gonzalez ..... H01L 31/022433 156/272.8

OTHER PUBLICATIONS

European Extended Search Report dated May 8, 2018, for European Application No. 18151508.1 (6 p.).

* cited by examiner

*Primary Examiner* — Tyrone V Hall, Jr.
*Assistant Examiner* — Makena S Markman
(74) *Attorney, Agent, or Firm* — Conley Rose, P.C.

(57) ABSTRACT

Gripping apparatus includes a body, a pair of legs extending from the body and separated by a gap, and a gripping head opposite the legs. A magnet or other adhering fastener is supported on an inwardly facing surface of the legs. The legs straddle an extendable member of a chuck device, the adhering fastener retaining the body on the extendable member. The gripping head includes teeth or another gripping surface for engaging a tubular member that is disposed in the chuck.

23 Claims, 5 Drawing Sheets

APPARATUS AND METHODS FOR GRIPPING A TUBULAR MEMBER

CROSS-REFERENCE TO RELATED APPLICATIONS

This application claims priority to U.S. Provisional Application No. 62/445,548 filed on Jan. 12, 2017 and titled "Apparatus and Methods for Gripping a Tubular Member" which is incorporated by reference in its entirety herein for all purposes.

STATEMENT REGARDING FEDERALLY SPONSORED RESEARCH OR DEVELOPMENT

Not applicable.

BACKGROUND

Field of the Disclosure

This disclosure relates generally to making and breaking/disconnecting threaded connections between elongate members. More particularly, it relates to an apparatus and system configured to make and break threaded connections between tubular members, such as those that are employed in drilling and production strings. Still more particularly, this disclosure relates to the gripping components for machines used in making and breaking threaded connections.

Background to the Disclosure

One type of assembly apparatus configured for making and disconnecting threaded connections between elongate members that are threaded together end-to-end is referred to as a make-up and break-out machine or a bucking unit. A typical make-up and break-out machine includes two chucks separated from each other along an axis. Each chuck contains multiple piston-cylinder assemblies that drive clamping heads toward the axis. The heads each have dies that bite into and grasp the tubular members that lie along the axis. The diameters of the piston-cylinder assemblies and the clamping heads are selected to provide sufficient strength for torqueing a selected maximum size/diameter of tubular members. At the same time, the size of the clamping heads and piston-cylinder stroke establishes a lower limit to the diameter of tubular member diameter that can be grasped without interference or collision between the multiple, convergent clamping heads. Thus, conventional machines are not capable of handling and manipulating the full range of tubular members that a shop or another operation intends to assemble. Greater range of grasp for a single assembly apparatus would be advantageous.

BRIEF SUMMARY OF THE DISCLOSURE

These and other needs in the art are addressed herein. In one embodiment, apparatus for gripping elongate members that are connected end to end and form a string comprises: a body; a pair of legs extending from the body and separated by a gap, wherein each leg comprises an inwardly-facing surface. An engagement surface extends between the pair of legs, and an adhering fastener is supported on at least one of the legs. The body includes a head portion opposite the legs. The head portion includes a gripping surface, as may be formed by teeth, grooves or other features, for engaging an elongate member of the string. The adhering fastener may be a magnet, suction cup or other non-threaded connector.

In some embodiments, each inwardly-facing leg surface comprises a recessed region and a non-recessed region, and wherein the adhering fastener is mounted to the recessed region. The recessed region may be disposed distal the engagement surface. In some embodiments, the engagement surface intersects the non-recessed regions of each leg in an obtuse angle.

In some embodiments, the apparatus further includes a chuck comprising an opening that is configured to receive an elongate member of the string. At least one extendable member is configured to be extended into the opening and has a body-supporting surface and a gripping surface. The adhering fastener engages the body-supporting surface of the extendable member, and the engagement surface engages the gripping surface of the extendable member. In certain embodiments, the hardness of the engagement surface of the body is less than the hardness of the gripping surface of the extendable member.

In still further embodiments, the apparatus further comprises: a plurality of extendable members circumferentially disposed about the opening and configured to extend into and retract from the opening in a radial direction, each of the plurality of extendable members having a body-supporting surface and a gripping surface. Each of a plurality of adapters is magnetically coupled to the body-supporting surface of one of the plurality of extendable members and comprises: a body; a pair of legs extending from the body and separated by a gap, each leg comprising an inwardly-facing surface that comprises a recessed region and a non-recessed region; an engagement surface extending between the non-recessed regions of each leg; and a magnet supported on at least one of the recessed regions. The body includes a head portion opposite the legs. A plurality of teeth extends from the head portion and forms a gripping surface for engaging an elongate member of the string.

In some embodiments, each leg includes an outwardly-facing surface that comprises a first portion that extends parallel to the inwardly-facing surface, and in some embodiments, the outwardly-facing surface of each leg further comprises a second portion that intersect the first portion in an obtuse angle.

Another embodiment includes gripping apparatus that comprises: a chuck that includes an opening configured to receive an elongate member of a string; a plurality of extendable members circumferentially disposed about the opening and configured to extend into and retract from the opening in a radial direction, each of the plurality of extendable members having a body-supporting surface and a first gripping surface. The apparatus includes a plurality of adapters, wherein each of the plurality of adapters is releaseably coupled to one of the plurality of extendable members. The adapters include: a body; a pair of legs extending from the body and straddling the body-supporting surface of one of the extendable members; a non-threaded connector on at least one of the pair of legs releasably coupling the body to the body-supporting surface of the extendable member. A head portion on the body, opposite the legs, includes a second gripping surface for engaging an elongate member of the string. In some embodiments, each of the plurality of adapters further comprises an engagement surface extending between each leg and contacting the first gripping surface of one of the plurality of extendable members. The non-threaded connector may be a magnet in some embodiments. In further embodiments, the hardness of the engagement surface of the body is less than the hardness of the first gripping surface of the extendable member.

Thus, embodiments described herein include a combination of features and characteristics intended to address various shortcomings associated with certain prior devices, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the disclosed exemplary embodiments, reference will now be made to the accompanying drawings.

NOTATION AND NOMENCLATURE

Figure 1:
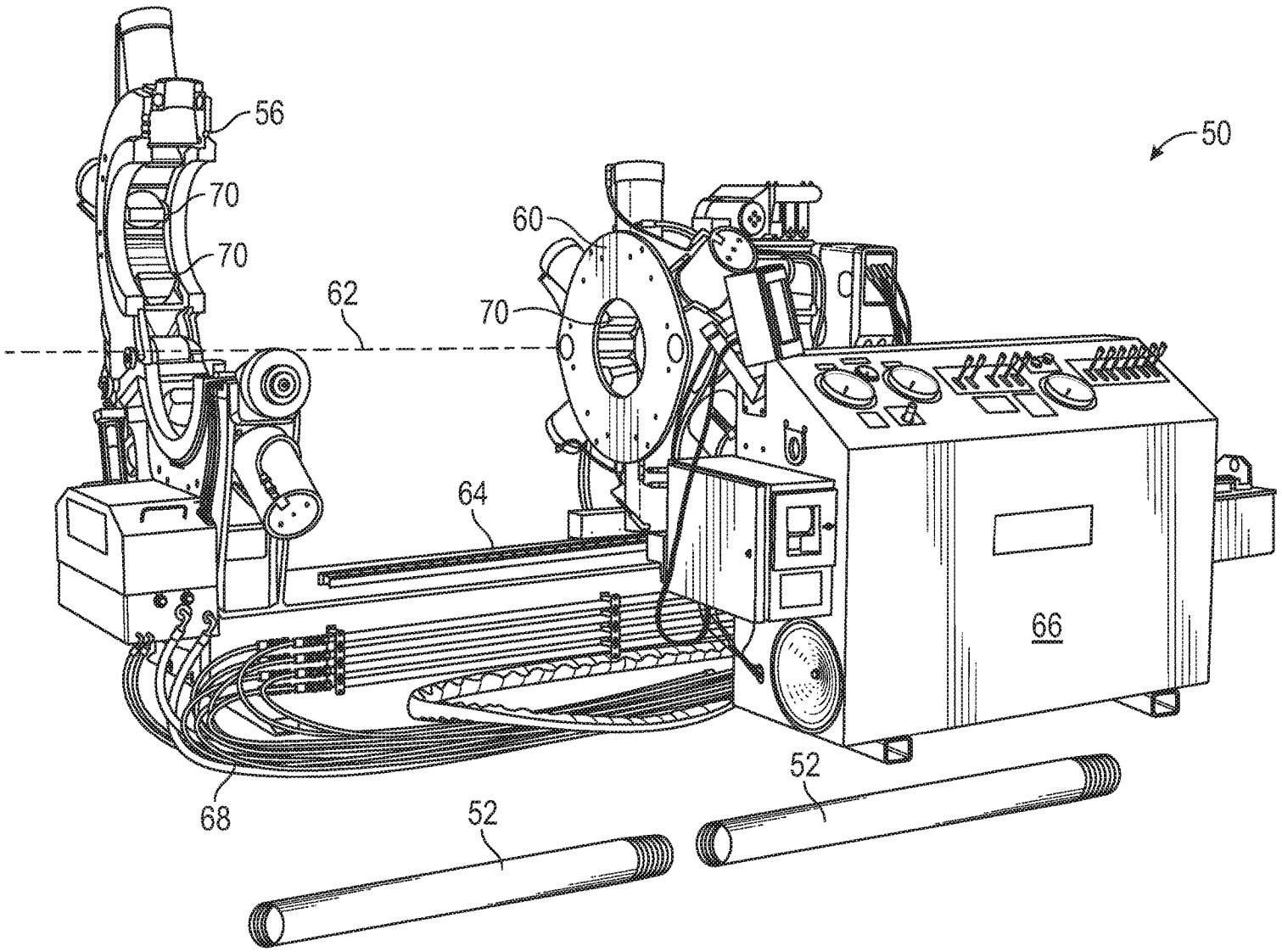
FIG. 1 shows a perspective view of an embodiment of a tool 50 that is configured for making and disconnecting threaded connection, tool 50 including a chuck with multiple gripping adapters in accordance with principles described herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not necessarily drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B."

In addition, the terms "axial" and "axially" generally mean along a given axis, while the terms "radial" and "radially" generally mean perpendicular to the axis. For instance, an axial distance refers to a distance measured along or parallel to a given axis, and a radial distance means a distance measured perpendicular to the axis. Furthermore, any reference to a relative direction or relative position is made for purpose of clarity, with examples including "top," "bottom," "up," "upper," "upward," "down," "lower," "clockwise," "left," "leftward," "right," and "right-hand." For example, a relative direction or a relative position of an object or feature may pertain to the orientation as shown in a figure or as described. If the object or feature were viewed from another orientation or were implemented in another orientation, it may be appropriate to describe the direction or position using an alternate term.

DETAILED DESCRIPTION OF THE DISCLOSED EXEMPLARY EMBODIMENTS

Referring to FIG. 1, in an exemplary embodiment, an assembly apparatus, specifically a tool 50 is configured for making and disconnecting threaded connections between elongate members, such as pieces of drill pipe 52 or, in another example, components of a downhole tool, such as a bottom hole assembly (BHA). Thus, the machine 50 is configured to assemble a string of tubular members or tools. Tool 50 includes a head stock chuck 56 spaced-apart from a tailstock chuck 60 along a gripping axis or chuck axis 62, a mounting rail 64 parallel to axis 62, a tool control unit 66, a hydraulic fluid supply 68, and multiple gripping adapters 70 mounted within chucks 56, 60. Chuck axis 62 is arranged horizontally and passes through chucks 56, 60 defining the location for drill pipes 52 when grasped by the chucks. Chuck 56 is rigidly coupled to one end of rail 64 and, in this embodiment, is of a split design capable of being hinged open to receive a tubular member in either the axial or radial directions with respect to axis 62. Chuck 60 is slidingly mounted to rail 64 and, in this embodiment, is of a closed design, allowing tubular members to slide axially through chuck 60.

Tool control unit 66 is integrated with sensors and actuators coupled to chucks 56, 60 and rail 64, and control unit 66 includes storage media with machine readable code configured to cause control unit 66, when executed, to monitor or govern the operation of tool 50. In various embodiments, the machine readable code includes instruction information to limit the toque exerted by tool 50 on tubular members.

In some embodiments, tool 50 is configured as a "bucking unit;" wherein, at least one of the chucks 56, 60 is configured for continuous revolution about axis 62. Either chucks 56, 60 may also be called a power tong. In some embodiments, a power tong having gripping adapters 70 is configured for use over a borehole when making and breaking (disconnecting) threaded connections between tubular members. For example, the power tongs may be mounted with axis 62 vertical, as is appropriate for installing or removing tubular members from the borehole.

Figure 2:
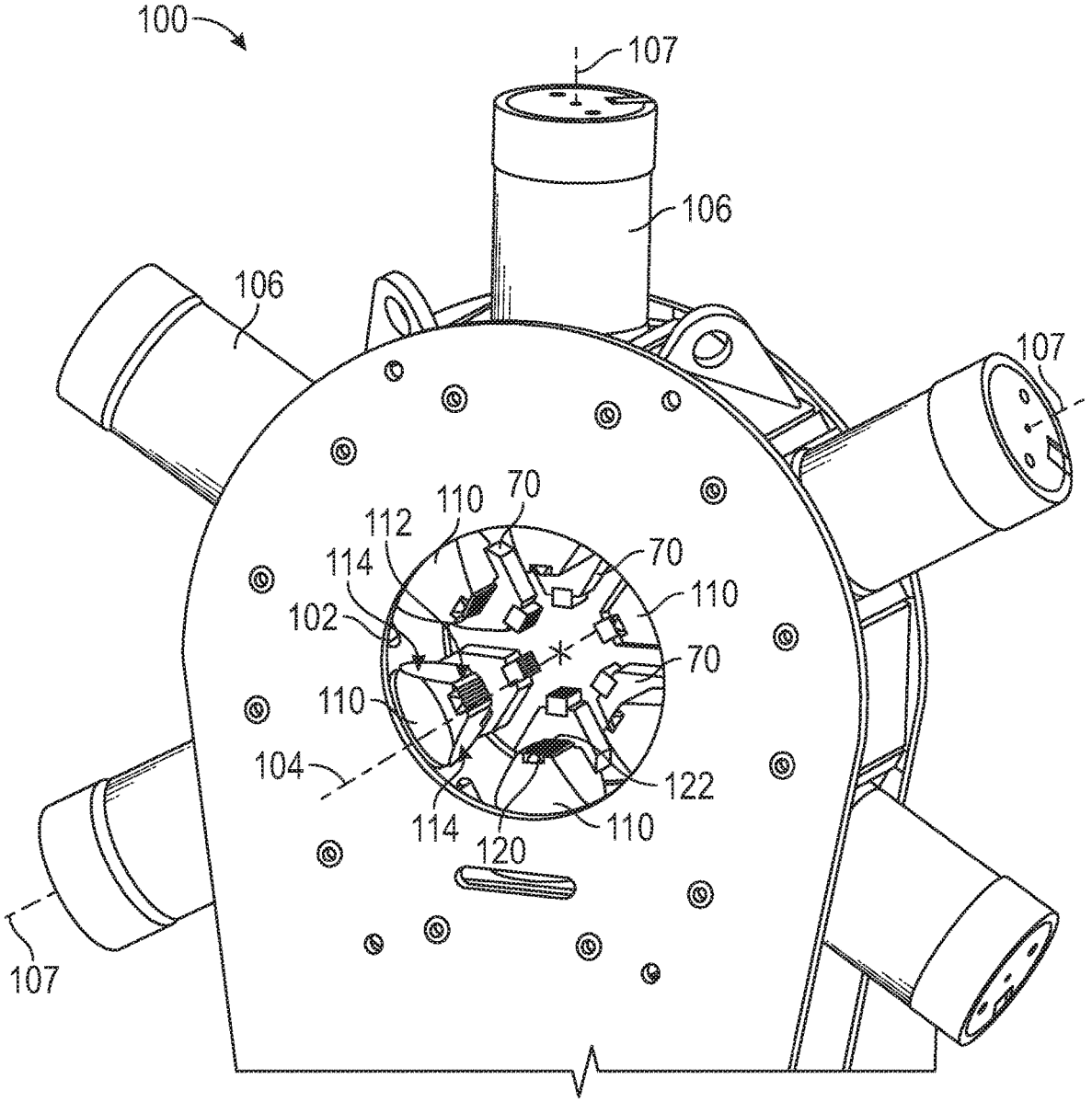
FIG. 2 shows a perspective front view of the chuck of FIG. 1 with multiple clamp heads and multiple gripping adapters in accordance with principles described herein.

Referring now to FIG. 2, in an exemplary embodiment, a collar or chuck 100 is of a closed design but in most other respects it is configured similar to either of the chucks 56, 60 and may also be called a power tong in some embodiments. For example, chuck 100 includes an opening 102, a chuck axis 104, and a plurality of gripping adapters 70 mounted on a plurality of hydraulic piston-cylinder assemblies 106, which may also be called, more simply, piston-cylinders 106. This example includes six pair of mating piston-cylinders 106 and adapters 70. Each piston-cylinder 106 includes an extendable member having a clamp head 110 with a front surface 112 and two, flat side surfaces 114 that are tapered with respect to surface 112 and are located on opposite sides of surface 112. The extendable member with clamp head 110 travels along a piston axis 107 perpendicular to chuck axis 104. A removable gripping element, a die 120, is coupled within a groove in clamp head 110 and extends beyond front surface 112. Die 120 includes a front or gripping surface 122 formed with a multiple teeth, grooves, notches, or a rough, sand-paper like texture, as examples. Each adapter 70 straddles and is supported on one of the clamp head 110 and the die 120 assemblies. Piston-cylinders 106 are circumferentially spaced about axis 104 with clamp heads 110 facing and extendable toward axis 104. The clamp head 110 may also be called a tong or a tong member. Adapter 70 extends the radial reach of clamp head 110 toward axis 104, configuring chuck 100 to grip and to torque smaller diameter tubular members than when the dies 120 are used contact and grip a tubular member. Thus, adapter 70 may be referred to as a tong extender or a removable tong. In various embodiments of tool 50 (FIG. 1), a chuck 100 replaces one or chucks 56, 60.

Figure 3:
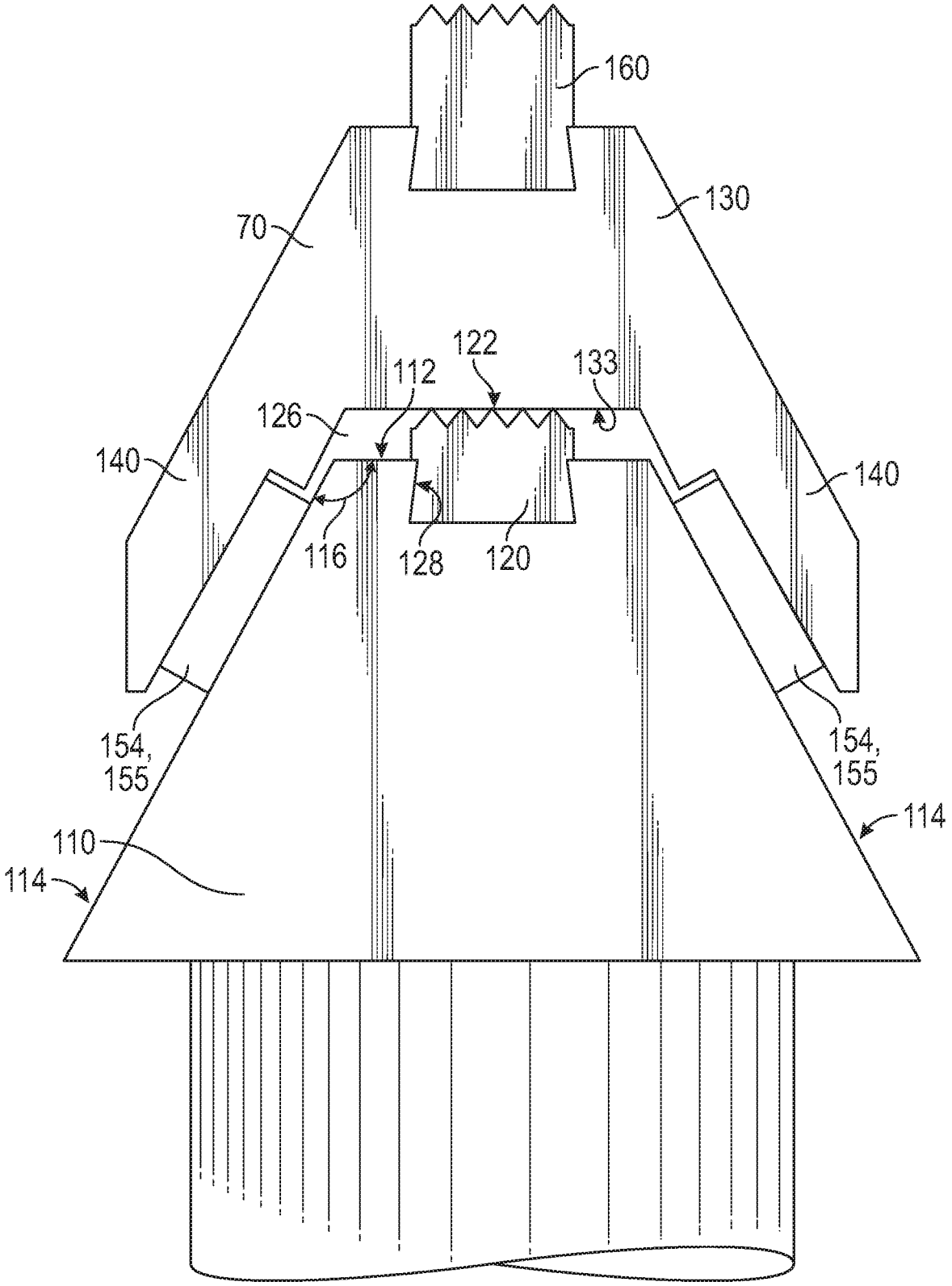
FIG. 3 shows an enlarged side view of a clamp head with one of the gripping adapters from FIG. 2.

As shown in FIG. 3, the orientation of each tapered side surface 114 with respect to front surface 112 on clamp head 110 is defined by an angle 116 which, at least in this example is obtuse. The general span of angle 116 is indicated in FIG. 3. When installed, gripping adapter 70 extends around surfaces 112, 114 of one of the clamp heads 110. Adapter 70 rests upon gripping surface 122 of die 120 and on tapered surfaces 114. On both sides of die 120, a gap 126 exists between adapter 70 and front surface 112 of head 110. Die 120, is coupled within a groove 128 that extends below front surface 112 of clamp head 110. Gripping adapter 70 includes a body 130, a pair of legs 140, multiple adhering fasteners 154, and a gripping element or die 160 coupled to and extending beyond body 130. Legs 140 straddle clamp head 110 and die 120. In this example, adhering fasteners 154 are magnets 155, and adapter 70 includes two magnets 155, one attached to each leg 140, positioned between leg 140 and one of the tapered surfaces 114 of clamp head 110. Magnets 155 adhere to surface 114 via magnetic force and being coupled to head 110 in this manner, magnets 155 configure adapter 70 to be easily installed on or removed from clamp head 110 without using tools. Magnets 155 provide a releasable coupling between adapter 70 and clamp head 110. Thus, at least in this embodiment, adhering fasteners 154 are non-threaded and may also be called non-threaded connectors herein, including in the claims.

Figure 4:
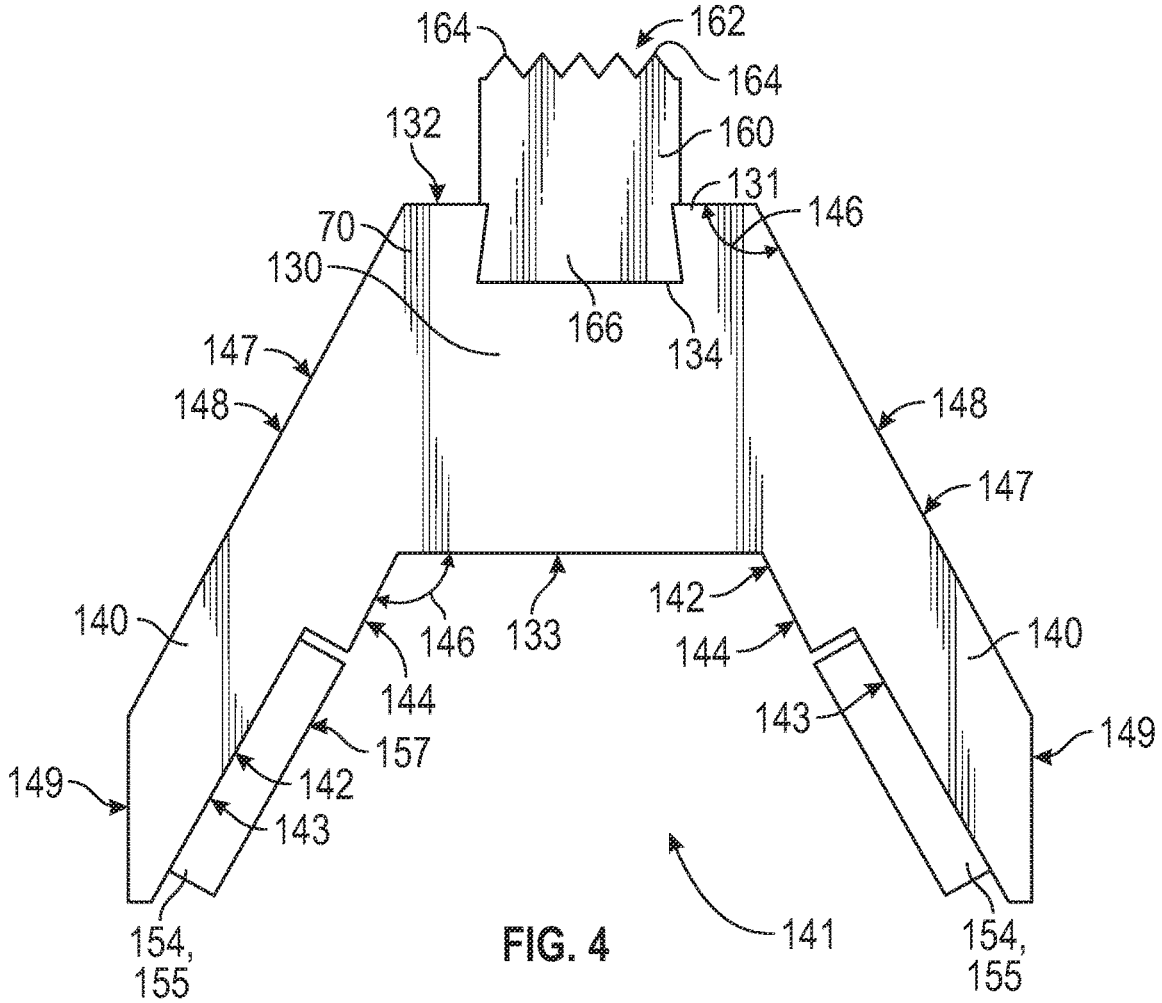
FIG. 4 shows a side view of one of the gripping adapters of FIG. 2.

FIG. 4 shows additional features of gripping adapter 70. Body 130 includes a head portion 131, a front surface 132 on head portion 131, a rear or engaging surface 133 opposite front surface 132, and a groove 134 extending into front surface 132. As best shown in FIG. 3, rear surface 133 engages gripping surface 122 when installed on clamp head 110. Each leg 140 extends outward from body 130 and beyond rear surface 133. Referring to both FIG. 3 and FIG. 4, the legs 140 extend away from each other as they extend from body 130. Considering a single leg, leg 140 includes an inwardly-facing surface 142 having a recessed region 143 distal the rear surface 133 and a non-recessed region 144 adjacent rear surface 133. Surface regions 143, 144 are spaced-apart and parallel. Surface regions 143, 144 are oriented at an angle 146 with respect to the body rear surface 133. Angle 146 has the same magnitude as the angle 116 that is disposed between front surface 112 and each side surface 114 of clamp head 110. Thus, angle 146 is obtuse. An outwardly-facing side surface 147 extends along leg 140 and body 130. In the exemplary embodiment, side surface 147 includes a first region 148 and a second region 149; wherein the first region 148 is oriented at the obtuse angle 146 with respect to front surface 132 to allow multiple adapters 70 to reach in and grip a small diameter tubular object when install in chuck 100. Thus, the first region 148 of side surface 147 is parallel to at least a region of inwardly-facing surface 142. In this embodiment, second region 149 of side surface 147 intersects the first region 148 in an obtuse angle.

Figure 5:
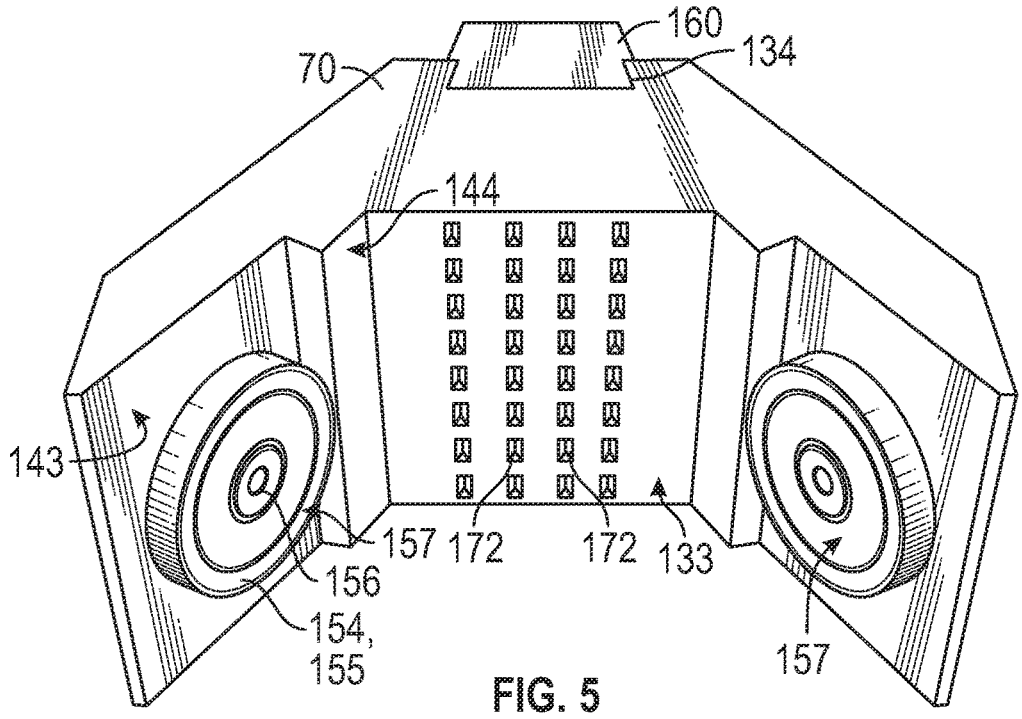
FIG. 5 shows a rear perspective view of the gripping adapter of FIG. 4.

As best shown in FIG. 5, the magnets 155 of this embodiment are held within recessed regions 143 and coupled to legs 140 by a machine screw 156, but any other suitable fastener or coupling arrangement could be used. Magnet 155 includes a mating surface 157 that is oriented so as to face or to contact the side surfaces 114 of clamp head 110 (FIG. 2). Preferably, in various embodiments, mating surface 157 is either co-planar with non-recessed region 144 of leg 140, or magnet 155 is thicker so that mating surface 157 extends beyond surface region 144 and further into gap 141. In some other embodiments, magnet 155 is thinner than shown such that mating surface 157 is located closer to surface region 142 and is not co-planar with surface region 144. The head of screw 156 is recessed within the body of magnet 155.

Die 160 is a gripping element that includes a gripping surface 162 formed with multiple teeth 164, grooves, notches, or a rough, sand-paper like texture, as examples. The rear portion 166 of die 160 is contoured to match groove 134 of adapter body 130. In FIG. 4 and FIG. 5, groove **1*k*34 is tapered with a trapezoidal shape, and rear portion 166 includes a dovetail shape that is slidingly and firmly held in groove 134. Die 160 may be removable and replaceable. Die 160 configures adapter 70 to grip elongate members and transfer torque from clamp head 110 or die 120. In various embodiments, in place of or in addition to the contoured end 166 and groove 134 of FIG. 4, die 160 may be coupled to adapter body 130 by any suitable technique known in the art, including welding, threaded fasteners, and adhesives, as examples. In some embodiments, rather than a dovetail shape, the groove in the adapter body and the rear portion of die 134 have a another cross-section, such as rectangular shape similar to groove 128 and die 120 of clamp head 110 in FIG. 3**.

Referring again to in FIG. 2 and FIG. 3, any of the surfaces 114, 122 of clamp 110 and die 120, may be called a body-supporting surface because body 130 of gripping adapter 70 is supported by them either directly or indirectly through legs 140. In some embodiments of chuck 100, clamp heads 110 lacks a separate gripping element or die 120 and, instead, adapter body 130 is supported by front surface 112 without a gap 126, such that front surface 112 is the surface directly supporting gripping adapter 70.

Rear surface 133 may also be called an engagement surface. In some exemplary embodiments, the hardness of rear surface 133 of body 130 is less than the hardness of the gripping surface 122 of the clamp head 110 and die 120. For example, body 130 and legs 140 of adapter 70 may be made of or include 1018 cold rolled steel, which may have, for example, a hardness of 116 Brinell or 35 Rockwell or greater, up-to the hardness limit of 1018 cold rolled steel. The die 120 of tong or clamp head 110 may have hardness between 58 and 62 Rockwell-C. Other hardness values for adapter 70 and die 120 are contemplated. With the die 120 of tong 110 having a hardness that is greater than the hardness of body 130 of adapter 70, clamp head 110 may dig into rear surface 133 of adapter 70 as a result of usage, as is shown in FIG. 5.

Figure 6:
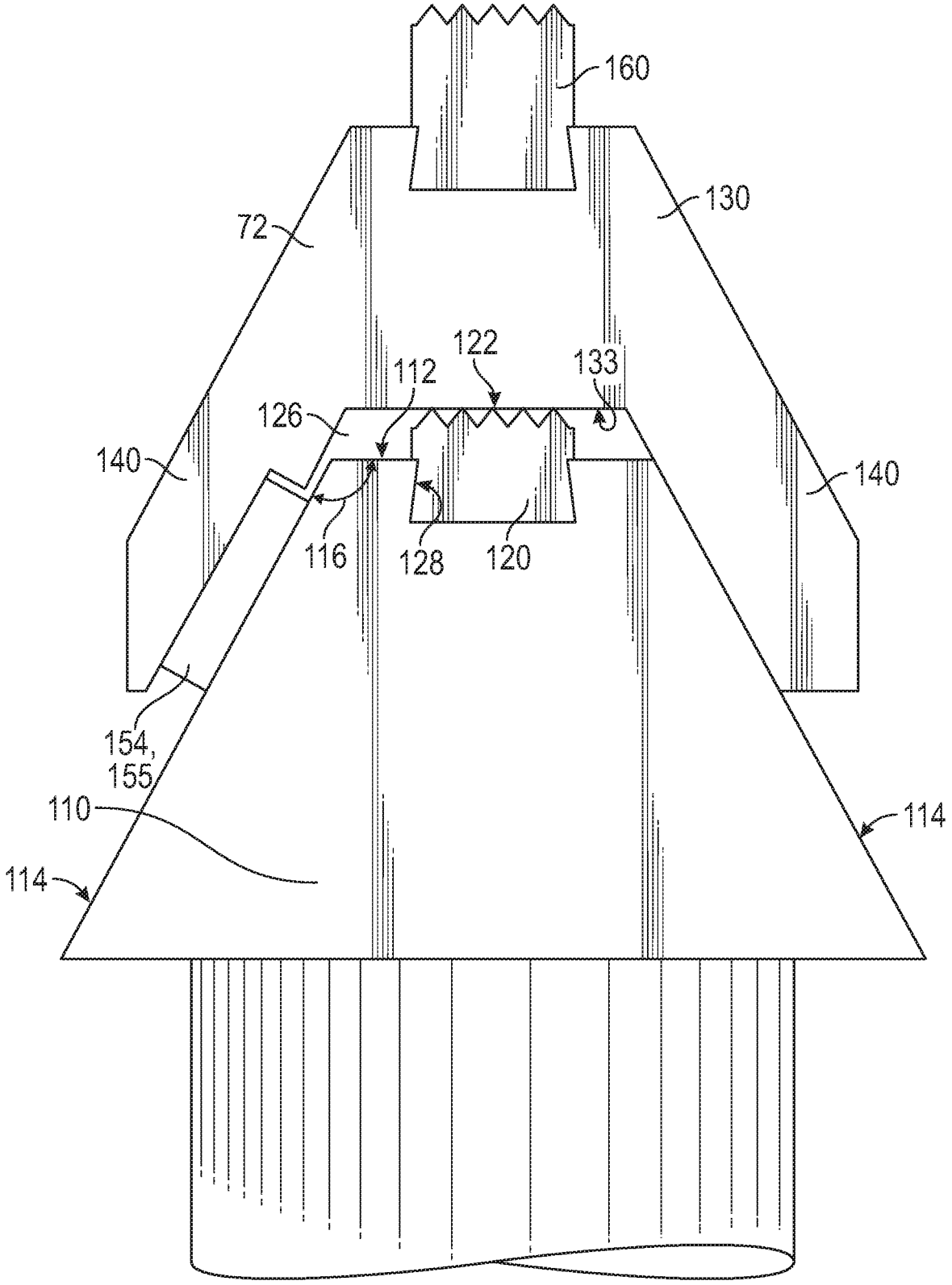
FIG. 6 shows an enlarged view of a clamp head of FIG. 3 with an embodiment of a gripping adapter having one adhering fastener, in accordance with principles described herein.

In FIG. 6 another exemplary embodiment is shown. Gripping adapter 72 is configured to be mounted on a clamp head 110 and includes the features previously described for adapter 70; however, adapter 72 includes an adhering fastener 154 only one leg 140. The other leg 140 is supported by upon surface 114 of head 110. Again, adhering fastener 154 is exemplified by magnet 155 in this embodiment.

Additional Information

Referring again to FIG. 1, Chuck 56 is configured to grip a first tubular member with or without the inclusion of a first group of adapters 70. Chuck 60 is configured to grip a second tubular member with or without the inclusion of a second group of adapters 70. Chuck 60 is also configured to rotate the second tubular member at least a portion of full revolution about axis 62 and relative to chuck 56 and the first tubular member in order to create a threaded coupling—with or without adapters 70. Chucks 56, 60 are also configured to perform their tasks without multiple adapters 70. Thus, tool 50 can operate to couple two tubular members with or without adapters 70.

When installed in chucks 56, 60, adapters 70 configure tool 50 to grip and rotate smaller diameter pipe than could normally be manipulated by tool 50. It is possible to operate tool 50 with adapters 70 installed in only one of the chucks 56, 60 while the other one of the chuck 56, 60 lacks adapters 70, configuring chucks 56, 60 to have two different ranges of radial grip.

Referring again to FIG. 2, although chuck 100 has been shown and described as including six pair of mating piston-cylinders 106 and adapters 70, some chucks and machines configured to use adapters 70 have more or fewer pair of mating piston-cylinders 106 and adapters 70, such as three, four, five, or seven, as examples.

Although gripping surface 162 on gripping adapter 70 is shown as generally planar, except for the previously described teeth, notches, groves or other gripping texture provided on the surface; in some embodiments, a gripping surface on adapter 70 is curved. Likewise, a gripping surface 122 of chuck 100 is curved in some embodiments.

In FIGS. 3-6, the recessed region 143 of inwardly-facing surface 142 is exemplified as a rectangular groove, but other shapes are possible in other embodiments, including a bore hole extending into non-recessed region 144. Still other embodiments include an inwardly-facing surface 142 that is continuously planar, lacking a recessed region 144 so that adhering fastener 154 is mounted on a non-recessed region 144. The adhering fastener for adapter 70 has been exemplified by a magnet 155; however, in some embodiments another type of releasable, non-threaded fastener or connector known in the art may be used, such as, for example, a suction cup, a Velcro®-type lock & loop fastener, adhesive tape, an adhesive substance, or a clasp that grasps clamp head 110 or grasps a protrusion that extends from clamp head 110. In other embodiments, an adhering fastener 154 is replaced by a threaded fastener as a component that threadingly couples adapter 70 to clamp head 110. Various embodiments of the gripping adapters 70 may be configured to mount to a chuck of a lathe or another milling machine.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatuses, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially.

What is claimed is:

1. Apparatus for gripping elongate members that are connected end to end and form a string, comprising:

a body comprising a head portion with a first gripping surface for engaging an elongate member of the string, the body further comprising a pair of legs that extend from the body in a direction away from the second gripping surface;

wherein the pair of legs are separated by a gap, each leg comprising an inwardly facing surface;

an engagement surface extending between the pair of legs, the engagement surface intersecting the inwardly-facing surface of each leg in an obtuse angle;

an adhering fastener supported on at least one of the legs;

a chuck comprising an opening that is configured to receive therein the elongate member of the string;

at least one extendable member configured to be extended into the opening and having a die attached at an end of the extendable member and a body-supporting surface, the die including a second gripping surface configured to grip the elongate member of the string;

wherein the adhering fastener engages the body-supporting surface of the extendable member, and the engagement surface engages the second gripping surface.

2. The apparatus of claim 1 wherein each inwardly-facing surface comprises a recessed region and a non-recessed region, and wherein the adhering fastener is mounted to the recessed region.

3. The apparatus of claim 2 wherein the adhering fastener comprises a magnet.

4. The apparatus of claim of 3 wherein magnet has a thickness equal to the depth of the recess.

5. The apparatus of claim 2 wherein the recessed region is distal the engagement surface.

6. The apparatus of claim 2 wherein the engagement surface intersects the non-recessed regions of each leg in an obtuse angle.

7. The apparatus of claim 2 wherein the adhering fastener comprises a suction cup.

8. The apparatus of claim 1 wherein a hardness of the engagement surface of the body is less a hardness of the second gripping surface.

9. The apparatus of claim 1 wherein each leg includes an outwardly-facing surface that comprises a first portion that extends parallel to the inwardly-facing surface.

10. The apparatus of claim 9 wherein the outwardly-facing surface of each leg further comprises a second portion that intersect the first portion in an obtuse angle.

11. Apparatus for gripping elongate tubular members that are connected end to end and form a string, comprising:

a chuck comprising an opening that is configured to receive therein an elongate member of the string;

a plurality of extendable members circumferentially disposed about the opening and configured to extend into and retract from the opening in a radial direction, each of the plurality of extendable members having a die attached at an end of the extendable member and a body supporting surface, the die having a first gripping surface configured to grip the elongate member of the string;

a plurality of adapters, wherein each of the plurality of adapters is releasably coupled to one of the plurality of extendable members and comprises:

an adapter body comprising a head portion with a second gripping surface for engaging the elongate member of the string, the body further comprising a pair of legs that extend from the body in a direction away from the second gripping surface;

wherein the pair of legs straddle the body-supporting surface of one of the extendable members;

a non-threaded connector on at least one pair of legs releasably coupling the adapter body to the body-supporting surface of the extendable member;

a plurality of teeth extending from the second gripping surface for engaging the elongate member of the string.

12. The apparatus of claim 11 wherein each of the plurality of adapters further comprises an engagement surface extending between each leg and contacting the first gripping surface of one of the plurality of extendable members.

13. The apparatus of claim 11 wherein the non-threaded connector is a magnet.

14. The apparatus of claim 12 wherein a hardness of the engagement surface of the body is less than a hardness of the first gripping surface of the die.

15. Apparatus for gripping elongate members that are connected end to end and form a string, the apparatus comprising:

a body comprising a head portion with a first gripping surface that includes a plurality of extending teeth for engaging an elongate member of the string, the body further comprising a pair of legs that extend from the body in a direction away from the first gripping surface;

wherein the pair of legs are separated by a gap, each leg comprising an inwardly-facing surface that comprises a recessed region and a non-recessed region;

an engagement surface extending between the non-recessed regions of each leg;

a magnet supported on at least one of the recessed regions;

a chuck comprising an opening that is configured to receive therein the elongate member of the string;

at least one extendable member configured to be extended into the opening and having a body-supporting surface and a second gripping surface;

wherein the magnet engages the body-supporting surface of the extendable member and the engagement surface engages the second gripping surface of the extendable member.

16. The apparatus of claim 15 wherein the engagement surface intersects the non-recessed regions of each leg in an obtuse angle.

17. The apparatus of claim 15 wherein for each leg, the recessed region is distal from the non-recessed region.

18. The apparatus of claim 15 wherein a hardness of the engagement surface of the body is less than a hardness of the second gripping surface of the extendable member.

19. The apparatus of claim 15 wherein the magnet has a thickness equal to the depth of the recess.

20. The apparatus of claim 15 wherein each leg includes an outwardly-facing surface that comprises a first region that extends parallel to the inwardly-facing surface.

21. The apparatus of claim 20 wherein the outwardly-facing surface of each leg further comprises a second region that intersects the first region in an obtuse angle.

22. The apparatus of claim 20 wherein each leg comprises an inwardly-facing surface, and wherein the engagement surface of the body intersects the inwardly-facing surface of each leg of the pair in an obtuse angle.

23. The apparatus of claim 20 further comprising a magnet fastened to the inwardly-facing surface of each of the legs of the pair.

* * * * *